US005858546A

United States Patent [19]

Sugita et al.

[11] Patent Number: 5,858,546

[45] Date of Patent: Jan. 12, 1999

[54] THERMAL TRANSFER RECORDING MEDIUM

[75] Inventors: Satoru Sugita; Takeshi Sagara; Toshimichi Harada, all of Tochigi, Japan

[73] Assignee: Sony Chemical Corporation, Tokyo, Japan

[21] Appl. No.: 666,468

[22] PCT Filed: Nov. 7, 1995

[86] PCT No.: PCT/JP95/02274

§ 371 Date: Sep. 20, 1996

§ 102(e) Date: Sep. 20, 1996

[87] PCT Pub. No.: WO96/14214

PCT Pub. Date: May 17, 1996

[30] Foreign Application Priority Data

Nov. 7, 1994 [JP] Japan ..... 6-272117

[51] Int. Cl.[6] ..... B41M 5/40

[52] U.S. Cl. ..... 428/447; 428/195; 428/423.1; 428/484; 428/488.4; 428/500; 428/913; 428/914

[58] Field of Search ..... 428/195, 488.4, 428/423.1, 447, 913, 914, 500; 503/227

[56] References Cited

U.S. PATENT DOCUMENTS 4,895,829 1/1990 Hanada et al. ..... 428/195
5,290,623 3/1994 Kawahito et al. ..... 428/195
5,352,527 10/1994 Harada et al. ..... 428/423.1

FOREIGN PATENT DOCUMENTS 3-24995 2/1991 Japan ..... 428/195
3-155987 7/1991 Japan ..... 428/195
4-4191 1/1992 Japan ..... 428/195

*Primary Examiner*—Bruce H. Hess
*Attorney, Agent, or Firm*—Jay H. Maioli

[57] ABSTRACT

A thermal transfer recording medium where a fusion thermal ink layer is formed on one side of a support and a heat-resistant sliding layer is formed on the other side of the support. The heat-resistant sliding layer is comprised of silicone copolymer having functional groups and isocyanate compound, and the ratio of the silicone copolymer having functional groups to isocyanate compound is within a range of 70:30 to 50:50 by weight. It is preferred that the functional groups include carboxyl groups and the silicone copolymer include polyorganosiloxane graft polymer whose main chain is vinyl copolymer. In addition, the amount of silicon in the silicone copolymer is within a range of 30 to 50%, the acid value of the silicone copolymer is within a range of 50 to 70 mg/KOH. On the other hand, polyisocyanate having three or more functional groups is used for the isocyanate compound; for example, an adduct of xylylene di-isocyanate having two functional groups and trimethylolpropane is used.

6 Claims, 1 Drawing Sheet

THERMAL TRANSFER RECORDING MEDIUM

TECHNICAL FIELD

This invention relates to a thermal transfer recording medium (so called ink ribbon) for use in a fusion-type thermal transfer recording, a sublimation-type thermal transfer recording, or the like.

BACKGROUND ART

A thermal transfer recording medium, so-called ink ribbon, on which a thermal fusion wax layer and a thermal sublimation transfer layer are formed makes direct contact with a thermal head; therefore, the medium requires heat resistance and a sliding ability, and for such, a heat-resistant sliding layer is usually formed on the backside of a support (a base film).

Many studies have been made on the heat-resistant sliding layer composed of silicone-based materials. Such silicone-based materials include heat-resistant resins such as silicone resin, epoxy resin or the like (Japanese patent application laid-open publication No. 7,467/80, etc.), silicone wax (Japanese patent application laid-open publication No. 137, 693/85, etc.), silicone oil (Japanese patent application laid-open publication No. 148,697/84, Japanese patent application laid-open publication No. 273,887/87, etc.).

However, as speed of thermal transfer printers increases and the shape of a thermal head changes, various problems are posed. For example, residue is formed when the thermal head bears against the heat-resistant sliding layer, and the layer is allowed to melt by the heat of the thermal head, resulting in its sticking. Residue forming at the heat-resistant sliding layer is such a phenomenon that the layer is ground by contact with the thermal head and resulting residue sticks to the thermal head, depending on the adhesion between the base film and heat-resistant sliding layer, the sliding ability, hardness of the heat-resistant sliding layer, and the like. If these characteristics are not well-balanced, the entire layer falls off in the worst cases.

This phenomenon leads to the inability of print at the part where residue remains between the heat-resistant sliding layer and the thermal head resulting in poor heat conductivity from the thermal head to an ink layer. As a result, there is a tendency that printed letters and numbers become illegible and a record can also be misread, as in the case of printed bar codes or the like.

Moreover, particularly in the case where silicone oil is used, the silicon oil is transferred to the ink layer and the recording quality becomes degraded if the ink ribbon is stored with the ribbon rolled up tightly.

In order to solve these problems, there have been attempts to modify the silicone oil and resin, and it has been reported that silicone-(meth)acrylic graft polymer made from the combination of silicone macromer and (meth)acrylic polymer showed good results (for example, Japanese patent application laid-open publication No. 143,195/86, Japanese patent application laid-open publication No. 1,575/87, Japanese patent application laid-open publication No. 30,082/87, Japanese patent application laid-open publication No. 214, 475/89, Japanese patent application laid-open publication No. 274,596/90, and the like.)

In the case where the aforesaid silicone-(meth)acrylic graft polymer is used for the heat-resistant sliding layer, the (meth)acrylic component is oriented on a side of a support (a base film), and the silicone is oriented on the other side, or the side of the heat-resistant sliding layer. Therefore, both strong adhesion to the support and good sliding ability are expected to be achieved.

However, as a result of study and investigation made by the present inventors, it has been formed that further improvement was necessary since the residue formation still remained and the amount of residue increased with high-speed printing though the sliding characteristics were slightly improved by using the aforesaid silicone-(meth) acrylic graft polymer.

DISCLOSURE OF THE INVENTION

An object of the present invention is to provide a thermal transfer recording medium which has a heat-resistant sliding layer with excellent heat-resistant and sliding characteristics; there should be no problems with blocking and residue formation of the heat-resistant sliding layer, and it should have an excellent sliding ability.

The present inventors have made various experiments for a long time to achieve the above-mentioned object. As a result, the present inventors have found that physical characteristics of a heat-resistant sliding layer are improved, namely heat resistance is increased and residue formation is largely decreased by introducing functional groups into silicone-(meth)acrylic graft polymer, and further using isocyanate as a hardening agent.

The present invention, which has been completed based on the results mentioned above, is related to a thermal transfer recording medium wherein a fusion thermal ink layer is formed on one side of a support and a heat-resistant sliding layer is formed on the other side of the support, wherein said heat-resistant sliding layer includes silicone copolymer having functional groups and an isocyanate compound, wherein the ratio of the silicone copolymer having functional groups to the isocyanate compound is within a range of 70:30 to 50:50 by weight.

Hereat it is preferred that the functional groups are carboxyl groups and silicone copolymer is polyorganosiloxane graft polymer whose main chain is vinyl copolymer.

In addition, the preferred amount of silicone in the silicone copolymer is within a range of 30 to 50% and, preferable acid value of the silicone copolymer is within a range of 50 to 70 mg/KOH.

On the other hand, polyisocyanate having three or more functional groups is used for the isocyanate compound; for example, an adduct of xylylene di-isocyanate having two functional groups with trimethylolpropane is used.

Since silicone copolymer having a sliding ability and functional groups which react with a hardening agent is used as the main component of the heat-resistant layer, and since it is mixed at a particular proportion with isocyanate compound as the hardening agent in the present invention, both excellent adhesion to the base film and sliding ability of the thermal head are achieved; moreover, the formation of residue is prevented in addition to an improvement in heat resistance and the stability in preservation.

Also, since the hardening agent is an elastic isocyanate compound, the heat-resistant sliding layer has a flexibility and the formation of residue is further reduced.

Additionally, the present invention has an advantage in that it can easily be adapted to printing conditions and printer characters since it has become easier to change the characteristics of the main chain by adopting polyorganosiloxane graft polymer with a main chain of vinyl copolymer as the silicone copolymer mentioned above.

Furthermore, the reaction of the copolymer, adopting carboxyl groups as the functional groups mentioned above, with isocyanate is easier than with a copolymer having other functional groups, although the reason is not clear, so that the sliding ability of the heat-resistant sliding layer is increased, and the formation of residue is prevented.

In addition, the characteristic where compatibility with a hardening agent decreases when the amount of silicon in the silicone copolymer is 30% or more by weight can be utilized. That is, since a phase separate between the silicone copolymer and the harding agent is promoted by an amount of silicone of 30% or more, the sliding ability of the heat-resistant sliding layer can be improved and the formation of residue can be prevented by orienting a relatively large amount of polyorgano-siloxane on the side of the heat-resistant layer.

As described above, the present invention can improve the heat resistance of a heat-resistant sliding layer, largely reduce residue formation on the heat-resistant sliding layer, and provide a thermal transfer recording medium having an excellent printing quality.

The preservation characteristics can be improved since the heat-resistant sliding layer mentioned above does not experience blocking after storage at high temperatures and, moreover, the sliding ability is excellent and stable since the friction coefficient of the heat-resistant sliding layer is low.

BEST MODE FOR CARRYING OUT THE INVENTION

Figure 1:
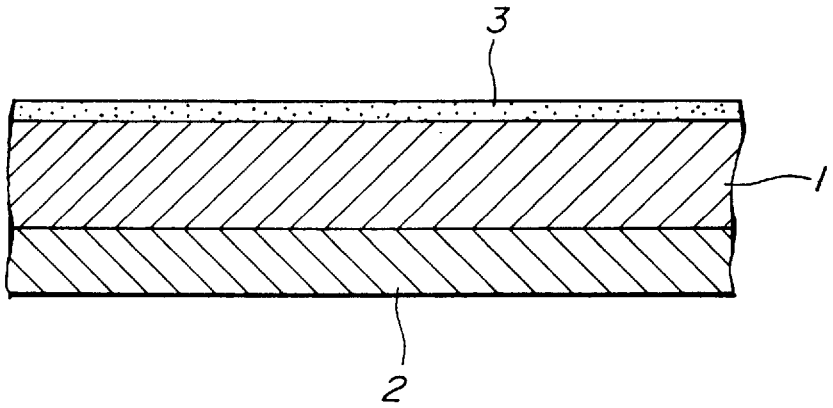
FIG. 1 is an enlarged sectional view showing the composition of an essential part of the thermal transfer recording medium according to the present invention.

The silicone copolymer of the present invention may include any copolymer composed of a monomer with a siloxane bond and another monomer though not restricted thereto. Random copolymer, block copolymer and graft copolymer are also usable as the silicone copolymer. Example of suitable silicone copolymers may include silicone-(meth)acrylic graft polymer, silicone-modified urethane resin, silicone-modified polyester resin, silicone-modified alkyd resin, and the like. Silicone-(meth)acrylic graft polymer is preferable among these copolymers since a component other than silicone can be easily introduced to it.

Silicone-(meth)acrylic graft polymer, which contains a main chain of (meth)acrylic ester or the like with polyorgano-siloxane (for example, polydimethyl siloxane) added as a side chain, is made by the polymerization of a silicone macromonomer having a radical polymerization site(double bond) on one end of the polyorgano-siloxane with (meth)acrylic ester. Of course, beside this, polymers made by a known method reported in, for example, Japanese patent application laid-open publication No. 214,475/89, Japanese patent application laid-open publication No. 274,596/90, Japanese patent publication No. 73,391/92, Japanese patent application laid-open publication No. 1,575/87, Japanese patent application laid-open publication No. 30,082/87, etc. are also applicable.

In the above-mentioned silicone copolymer, the amount of silicon defined by the formula listed below, which is decided by the prepared amount needed to synthesize polyorgano-siloxane, is preferably 30% or more. If the amount of silicone mentioned above is less than 30%, the compatibility of the isocyanate compound with silicone copolymer increases, and the silicone copolymer becomes more difficult to orient on the surface side of the heat-resistant sliding layer. On the other hand, if the amount of silicone is more than 50%, it is difficult to synthesize the silicone copolymer.

$$\frac{\text{Monomer component having a silicone bond}}{\text{Silicone copolymer component}} \times 100\%$$

In addition, it is preferred that the entire molecular weight of the above-mentioned silicone copolymer be within a range of 5,000 to 100,000, and that of polyorgano-siloxane be within a range of 5,000 to 50,000.

In above-mentioned silicone copolymer, (meth)acrylic ester or the like is used as other components than polyorgano-siloxane. Specific examples of the other components may include methyl acrylate, methyl methacrylate, ethyl acrylate, ethyl methacrylate, propyl acrylate, propyl methacrylate, butyl acrylate, butyl methacrylate, isobutyl acrylate, isobutyl methacrylate, t-butyl acrylate, t-butyl methacrylate, isoamyl acrylate, isoamyl methacrylate, cyclohexyl acrylate, cyclohexyl methacrylate, 2-ethyl hexyl acrylate, 2-ethyl hexyl methacrylate, n-methylol acrylic amide, 2-hydroxy ethyl acrylate, 2-hydroxy ethyl methacrylate, 2-hydroxy propyl acrylate, 2-hydroxy propyl methacrylate, 2-hydroxy butyl acrylate, 2-hydroxy butyl methacrylate, 2-hydroxy-3-phenoxy propyl acrylate, acrylic acid, methacrylic acid, acryloiloxy ethyl monosuccinate, glycidyl methacrylate, 2-aziridinyl ethyl methacrylate, 2-aziridinyl aryl propionate, acrylic amide, methacrylic amide, diacetone acrylic amide, dimethyl amino ethyl methacrylate, diethyl amino ethyl methacrylate, 2-acrylic amide-2-methyl propane sulfonic acid, or the like. Further, an addition product of di-isocyanate such as equivalent addition products or the like of 2,4-toluene di-isocyanate, 2-hydroxy ethyl acrylate, and radical polymerization type monomer having active hydrogen, vinyl ester of fatty acid such as vinylacetate, vinyl propionate, styrene, a-methyl styrene, vinyl toluene, maleic anhydride, itaconic acid, or the. like are also usable as the other components of the silicone copolymer. These monomers can be used singly or more than two of them can be used together. Particularly polymer having a functional group (carboxyl group) in a main chain is produced when an acid component such as acrylic acid, methacrylic acid or the like is used together.

Though the amount of the above-mentioned functional groups, carboxyl groups, is arbitrary, it is preferred that the amount be 50 mg/KOH to 70 mg/KOH by acid value from the aspect of physical characteristics of the heat-resistant sliding layer and productivity. If the acid value is less than 50 mg/KOH, the silicone copolymer is difficult to have sufficient characteristics. If the acid value is more than 70 mg/KOH, it is difficult to produce. The acid value mentioned here, is the amount of potassium hydroxide required to neutralize carboxyl groups in 1 mg of the polymer, and the larger the acid value is, the more carboxyl group it contains.

On the other hand, the isocyanate compound used with the above-mentioned silicone copolymer is an ester of isocyanic acid which is shown in the general formula of RN═C═O, and the reaction in the present invention is shown in the following chemical formula.

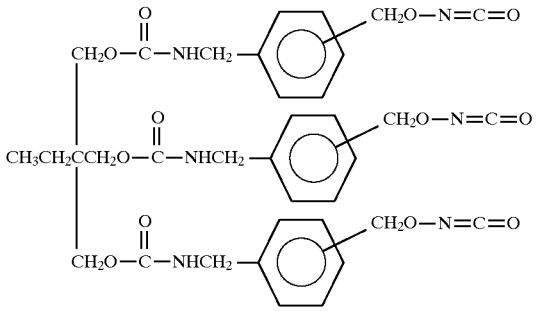

In the present invention, isocyanate having two functional groups and polyisocyanate are applicable. Examples, of isocyanate having two functional groups may include, tolylene-di-isocyanate (TDI), 4,4-diphenylmethane di-isocyanate (MDI), xylylene di-isocyanate (XDI), hexamethylene di-isocyanate (HDI), trimethyl hexamethylene di-isocyanate (TMDI), TDI hydride, MDI hydride, XDI hydride, or the like.

Polyisocyanate can be produced from isocyanate having two functional groups and other compounds. Specific examples of polyisocyanates may include an adduct of xylylene di-isocyanate with trimethylol propane (TMP) described by the following chemical formula or the like.

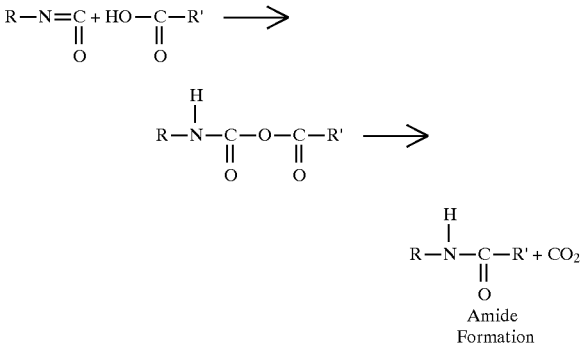

Besides typical examples of polyisocyanates may include an adduct of tolylene di-isocyanate and TMP, of hexamethylene diisocyanate and TMP, and the like.

Accordingly, these isocyanate compound can be produced by a known method but commercially available product also can be used.

In the thermal-transfer recording medium according to the present invention, the heat-resistant sliding layer includes the above-mentioned silicone copolymer and isocyanate compound, and the weight ratio of the silicone copolymer to the isocyanate compound is within a range of 70:30 to 50:50.

If the weight ratio is out of this range, decreasing in heat resistance, the formation of residue is likely to occur at the heat-resistant sliding layer. In addition, even if the weight ratio falls within the range, the effect cannot be obtained in the case where a hardening agent other than an isocyanate compound (for example, melamine, amine or the like) is used.

Further, the heat-resistant sliding layer can contain silicone resin, such as silicone oil, silicone rubber or the like; heat-resistant resin, such as epoxy resin, polyimide resin or the like; filler, such as silica, mica, silicon particles or the like; an anti-static agent; etc. other than the above-mentioned silicone copolymer and isocyanate compound.

The heat-resistant sliding layer is formed by coating the surface, which contacts the thermal head, with the above-mentioned component materials dissolved in a volatile solvent. The amount to be coated on the surface is normally 0.02 to 0.5 g/m$^2$. General coating methods such as gravure coating, roller coating, knife coating, curtain coating, rod coating, kiss coating and the like are applicable.

The present invention is applicable to any ink ribbon (a thermal transfer recording medium) for use in the printer of a thermal transfer system, such as a fusion thermal transfer recording system, a sublimation thermal transfer recording system, or the like, and particularly, it is applicable to a thermal transfer recording medium for a fusion thermal transfer system.

In the case of a fusion thermal transfer system, the ink layer, which forms character images by being transferred onto the medium to be printed by the heat of the thermal head, contains a coloring agent, a thermally fusing substance, a viscosity control agent, filler, and the like.

Example of the coloring agent used for the above-mentioned ink layer may include an organic pigment, a non-organic pigment, dye, or the like. For example, carbon black, or the like, can be used for a black ink layer.

Example of the thermally fusing substance, whose main component is wax, may include natural wax (for example, carnauba wax, candelilla wax, bees wax, whale wax, Japanese wax), petroleum wax (for example, petrolatum, paraffin, microcrystalline), synthetic wax (for example, stearic amide, phthalic anhydride imide), and so on.

As the viscosity control agent, fats or oils such as oil, plasticizer, paraffin with a low melting point, lanoline, or the like are usable to reduce viscosity, while ethylene-vinylacetate copolymer, modacrylic resin, stylene or its derivatives, polyester resin, rosin or its derivatives, terpene or terpene phenol, $C^5$ petroleum resin, $C_9$ petroleum resin, natural rubber, isoprene rubber, styrene-butadiene rubber, nitrile rubber, butyl rubber, or the like is usable to increase viscosity.

As the. filler, silica, mica, silicon particles, clay, or the like can be used.

After an ink compound containing the components mentioned above is dissolved in a volatile solvent, the obtained solution can be coated by the method of hot solvent. Gravure, roller coater, or the like can be used to coat the solution and the thickness of the coating may be normally in the range of 1.0 to 10 g/m$^{2.}$ A known film and paper with a thickness of 2 to 10 m can be used as the base film (support) on which the above-mentioned heat-resistant sliding layer and ink layer are formed. They are, for example, a plastic film having a comparatively good heat resistance, such as polyester, polycarbonate, polyethylene naphthalate, triacetyl cellulose, polyamide, or the like, and cellophane, parchment, condenser paper, etc.

The preferred embodiments of the present invention are described in detail below by referring to the results of experiments.

EXAMPLE 1

As shown in FIG. 1, a heat transfer recording medium was formed by laying ink layer 2 on one side of support 1 and heat-resistant sliding layer 3 on the other side of the support.

Preparation of the heat-resistant sliding layer

The silicone copolymer and isocyanate compound used in this example are as follows:

Silicone copolymer: Silicone-methacrylic graft polymer

Product name: Symac US380 manufactured by TOA GOSEI KAGAKU K.K.;

silicone content: 40%, acid value:65 mg/KOH,

Tg: 120 degrees centigrade

Solid component 30% (solvent: methyl ethyl ketone)

Isocyanate solution: Product name: Takenate D-110N manufactured by TAKEDA YAKUHIN KOGYO K.K. Solid component 75% (solvent: ethyl acetate)

57.3 parts by weight of methyl ethyl ketone was put in a metal container and 18 parts by weight of silicone methacrylic graft polymer was stirred into the mixture. Next, 4.8 parts by weight of isocyanate was also stirred into the mixture and then 69.9 parts by weight of toluene was added to make the intended back-coat solution. The solid component of the back-coat solution is variable depending on the thickness of the coating, and the amount in this example was 6%. The weight ratio of silicone copolymer to isocyanate in the prepared back-coat solution was 60:40 by weight.

The above-mentioned back-coat solution was coated on a polyester film (4.8 m thick, manufactured by TEIJIN K.K.) to form the heat-resistant sliding layer. In the process, the amount of the solution which was coated was 0.1 g/m$^{2.}$ Preparation of ink layer The composition of the ink layer was as follows:

Carbon black 15 parts by weight (MONAC 120, manufactured by CABOT)

Carnauba wax 43 parts by weight (CARNAUBA 2 GOU, manufactured by NODA WAX K.K.)

Paraffin wax 30 parts by weight (HNP-10, manufactured by NIHON SEIRO K.K.)

Ethylene-vinylacetate copolymer 7 parts by weight (SUMITATE KC10, manufactured by SUMITOMO KAGAKU K.K.)

Dispersant 5 parts by weight (DISPARAN OF14, manufactured by YOSHIKAWA SEIYU K.K.)

Among the above-mentioned components, the carbon black, carnauba wax, paraffin wax and dispersant were mixed by a heat triple-roller to make a master batch. The mixture was then put in a heatable container which could be heated and was heated to a temperature between 120 and 140 degrees centigrade. After the master batch melted, the ethylene-vinylacetate was added to the batch, which was then stirred for one hour to make the intended ink compound.

The ink compound prepared in the above-mentioned process was hot-melt-coated on the side opposite to the surface where the heat-resistant sliding layer was formed on the abovementioned polyester film by gravure coating in order to form the ink layer and produce a heat transfer recording medium.

EXAMPLES 2 TO 6, COMPARATIVE EXAMPLES 1 TO 6

As shown in Tables 1A and 1B, a variety of samples were made by changing the ratio of the silicone copolymer to the isocyanate compound, the amount of silicone in the silicone copolymer, the acid value and, further, the hardening agent. Incidentally, the silicone copolymer in Example 4 was silicone-methacrylic graft copolymer manufactured by TOA GOSEI KAGAKU K.K. (Trade name: Symac US350); in example 5, it was silicone-methacrylic graft copolymer manufactured by TOA GOSEI KAGAKU K.K. (Trade name: Symac US270); in example 6, silicone-methacrylic graft copolymer manufactured by TOA GOSEI KAGAKU K.K. (prototype 1); in comparative example 5, silicone-methacrylic graft copolymer manufactured by TOA GOSEI KAGAKU K.K. (prototype 2); in comparative example 6, copolymer manufactured by SEKISUI KAGAKU (commercial product name: ESLEC BX-1); and in the other examples, it was the same copolymer as in example 1. Regarding the melamine resin, J820, a resin manufactured by DAINIHON INK K.K. was used.

TABLE 1A

| | Back blending (weight ratio) | | |
|---|---|---|---|
| Example NO. | Silicone copolymer | Isocyanate | Melamine |
| Example 1 | 60 | 40 | — |
| Example 2 | 50 | 50 | — |
| Example 3 | 70 | 30 | — |
| Example 4 | 60 | 40 | — |
| Example 5 | 60 | 40 | — |
| Example 6 | 60 | 40 | — |
| Comparative example 1 | 100 | 0 | — |
| Comparative example 2 | 90 | 10 | — |
| Comparative example 3 | 60 | — | 40 |
| Comparative example 4 | 40 | 60 | — |
| Comparative example 5 | 90 | 10 | — |
| Comparative example 6 | 60 | 40 | — |

TABLE 1B

| Example NO. | Amount of silicone | Acid value (mg/KOH) | OH value |
|---|---|---|---|
| Example 1 | 40 | 65 | — |
| Example 2 | 40 | 65 | — |
| Example 3 | 40 | 65 | — |
| Example 4 | 20 | 65 | — |
| Example 5 | 40 | — | 26 |
| Example 6 | 40 | 25 | — |
| Comparative example 1 | 40 | 65 | — |
| Comparative example 2 | 40 | 65 | — |
| Comparative example 3 | 40 | 65 | — |
| Comparative example 4 | 40 | 65 | — |
| Comparative example 5 | 40 | 20 | — |
| Comparative example 6 | — | — | — |

As to every example and comparative example mentioned above, the printing quality, heat resistance and formation of residue of the heat-resistant sliding layer, as well as the preservation characteristic and back peel, were assessed. The methods for assessment were as follows.

Printing quality

Printer: BC8MK-II, manufactured by Autenics

Printed pattern: Bar-code CODE39

Speed: 60 mm/sec

Print material: SK Coat Paper, manufactured by LINTEC

Applied energy: 14 mJ/mm$^2$ (standard applied energy)

Point of evaluation: To see through visual observation if printing quality, which is passable for all practical purposes, is achieved when printing under standard printing conditions.

Heat resistance of a. heat-resistant sliding layer

Applied energy 21 mJ/mm$^2$ (excess of applied

Other criteria: Same as those for printing quality

Point of evaluation: To see through visual observation if the heat transfer recording medium is damaged when an excess of energy is applied.

If it is seriously damaged, split, or wrinkled, a sticking phenomenon occurs and it won't slide smoothly.

A sticking phenomenon is one where excessive heat makes the heat-resistant sliding layer sticky, causing unsmooth sliding.

Formation of residue on a heat-resistant sliding layer

To print on 3,000 sheets of the above-mentioned SK Coat paper under the same conditions as those for the printing quality evaluation.

Point of evaluation: To see through visual observation if there are granules of residue or the like near a thermal head.

Preservation characteristic

Making a roll of a thermal transfer recording medium by rolling a tape of a heat transfer recording medium onto a core material, it was aged for 168 hours in an oven at 50 degrees centigrade and then taken out. The roll of thermal transfer recording medium was then observed for blocking or degradation of the printing quality.

Back peel

The thermal transfer recording medium was cut into a tape and fixed on a table with the heat-resistant sliding layer facing up by fastening it at its four corners. Then, pressure sensitive adhesive tape was stuck to it and the tape was peeled back 180 degrees with a force of 500 g. The force of the peeling was taken as the back peel.

The results are shown in Tables 2A and 2B. In the results of the evaluation in the table, ○ indicates "good",Δ indicates "normal", and x indicates "bad".

TABLE 2A

| Example NO. | Printing quality | Heat resistance of a sliding resistance layer | Formation of powder on a heat-resistance layer |
|---|---|---|---|
| Example 1 | ○ | ○ | ○ |
| Example 2 | ○ | ○ | ○ |
| Example 3 | ○ | ○ | ○ |
| Example 4 | ○ | ○ | ○ |
| Example 5 | ○ | ○ | Δ |
| Example 6 | ○ | ○ | Δ |
| Comparative example 1 | ○ | ○ | X |
| Comparative example 2 | ○ | ○ | X |
| Comparative example 3 | ○ | Δ | X |
| Comparative example 4 | ○ | Δ | X |
| Comparative example 5 | ○ | ○ | X |
| Comparative example 6 | X | X | Impossible to measure |

TABLE 2B

| Example NO. | Preservation | Back peeling/2.5 cm |
|---|---|---|
| Example 1 | ○ | 10 or less |
| Example 2 | ○ | 10 or less |
| Example 3 | ○ | 10 or less |
| Example 4 | ○ | 10 to 30 |

TABLE 2B-continued

| Example NO. | Preservation | Back peeling/2.5 cm |
|---|---|---|
| Example 5 | ○ | 10 to 30 |
| Example 6 | ○ | 10 to 30 |
| Comparative example 1 | ○ | 70 |
| Comparative example 2 | ○ | 70 |
| Comparative example 3 | ○ | 10 or less |
| Comparative example 4 | ○ | 10 or less |
| Comparative example 5 | ○ | — |
| Comparative example 6 | X | 100 or more |

As shown in the Tables 2A and 2B, residue formation on the heat-resistant sliding layer is largely reduced and an excellent printing quality is provided in each example of the heat-resistant sliding layer formed by mixing the silicone copolymer with the isocyanate compound at proper proportion.

On the other hand, in the comparative examples where the ratio of the silicone copolymer to isocyanate or the acid value was not proper, or the hardening agent was not isocyanate compound, residue formation occurred and the printing quality degraded. In addition, particularly if the amount of silicone in the silicone copolymer or the acid value was not proper, a lack in the adhesive quality (peeling strength) of the heat-resistant sliding layer was observed.

For example, even though back peel was small, the comparative example 3 didn't have good results. The reason was that the heat-resistant sliding layer lacked elasticity since melamine was used as the hardening agent.

In comparative example 5, even though back peel was small, the results were not good. The reason was that the heat-resistant sliding layer also lacked elasticity because of an excessively high concentration of cross linking degree since the amount of hardening agent was 50% or more.

What is claimed is:

1. A thermal transfer recording medium comprising:

a heat fusion thermal ink layer formed on one side of a support; and a heat-resistant sliding layer formed on the other side of the support, wherein the heat-resistant sliding layer comprises a silicone copolymer comprising a silicone-(meth) acrylic graft polymer made from a combination of a silicone macromonomer and a (meth) acrylic polymer and having at least a carboxll group and an isocyanate compound, wherein an acid value of the silicone copolymer is from 50 to 70 mg/KOH and such that a weight ratio of the silicone copolymer having at least a carboxyl group to the isocyanate compound is within a range of 70:30 to 50:50 by weight.

2. The thermal transfer recording medium according to claim 1, wherein the silicone copolymer is polyorganosiloxane graft polymer; a main chain of said polvorganosiloxane graft polymer is vinyl copolymer.

3. The thermal transfer recording medium according to claim 2, wherein the amount of silicone in the silicone copolymer is within a range of 30 to 50%.

4. The thermal transfer recording medium according to claim 1, wherein the isocyanate compound is polyisocyanate having at least three functional groups.

5. The thermal transfer recording medium according to claim 4, wherein the isocyanate compound is an adduct of xylylene di-isocyanate having two functional groups and trimethylol propane.

6. The thermal transfer recording medium according to claim 1, wherein the heat-resistant sliding layer has a back peel force of less than about 30 g per 2.5 cm.

* * * * *